United States Patent [19]

Okumura et al.

[11] 4,090,106

[45] May 16, 1978

[54] FIELD EMISION ELECTRON GUN WITH CONTROLLED POWER SUPPLY

[75] Inventors: Masahide Okumura, Hachioji; Yoshio Sakitani, Iruma; Yukichi Ueno, Katsuta, all of Japan

[73] Assignee: Hitachi, Ltd., Japan

[21] Appl. No.: 751,987

[22] Filed: Dec. 20, 1976

[30] Foreign Application Priority Data

Dec. 26, 1975 Japan ..... 50-155067

[51] Int. Cl.[2] ..... G05F 1/00; H05B 37/02

[52] U.S. Cl. ..... 315/107; 315/307; 315/360; 250/311; 328/9

[58] Field of Search ..... 328/9; 315/107, 307, 315/360

[56] References Cited

U.S. PATENT DOCUMENTS 3,825,839 7/1974 Someya et al. ..... 315/307 X

*Primary Examiner*—Alfred E. Smith
*Assistant Examiner*—Charles F. Roberts
*Attorney, Agent, or Firm*—Craig & Antonelli

[57] ABSTRACT

A field emission electron gun according to this invention comprises a cathode for emitting electrons, an anode, a high voltage source which applies a high voltage between the cathode and the anode in order to cause emission of electrons from the cathode, a reference voltage source, voltage control means for controlling and stabilizing the output voltage of the high voltage source in response to an output voltage of the reference voltage source, means for detecting the value of an emission current from the cathode, means for delivering as an output a signal corresponding to the difference between the detected value and a desired value, and means for applying the output signal to the reference voltage source through a switch. The reference voltage source includes means which, when the switch is in the closed state, controls the output voltage of the reference voltage source in response to the difference output signal, and means which, when the switch is in the open state, continues to hold the output voltage value of the reference voltage source immediately before the opening of the switch as it is. The electron gun of this invention accordingly conducts when the switch is in the closed state, a constant current operation which makes constant the emission current from the cathode, and conducts when the switch is in the open state, a constant voltage operation which makes constant the voltage applied between the cathode and the anode.

7 Claims, 9 Drawing Figures

FIELD EMISION ELECTRON GUN WITH CONTROLLED POWER SUPPLY

BACKGROUND OF THE INVENTION

1. FIELD OF THE INVENTION

This invention relates to improvements in a field emission electron gun, and more particularly to improvements in a power supply circuit thereof.

2. DESCRIPTION OF THE PRIOR ART

When a high negative voltage is applied to a needle-shaped electrode (cathode) whose tip is very sharp, electrons are emitted from a field crowding part of the tip even in case where the needle-shaped electrode is at the normal temperature. As is well known, an electron gun fabricated on the basis of such principle is called the field emission electron gun.

As compared with the case of a conventional thermionic gun, the field emission electron gun has the feature that an electron beam emitted therefrom has a high electron current density, so the diameter of the electron beam can be made very small. In recent years, therefore, the field emission electron gun has come into frequent use as the electron source of an electron beam instrument such as an electron microscope.

However, whereas the electron current of the conventional thermionic gun is almost invariable the lapse of time, the field emission electron current exhibits a unique time variation as shown by a curve *a* in FIG. 1. More specifically, the value of emission current changes abruptly from $I_o$ to $I_1$ during the period between a time $T_o$ at which the field emission begins operation and a time $T_1$ (usually, the period is called the initial unstable region). After the time $T_1$, the emission current exhibits almost no decrease and proceeds at a substantially constant value, whereupon it increases gradually and reaches a value $I_2$ at a time $T_2$ (usually, this period is called the stable region). It is in the stable region that the field emission electron gun can be stably used. After the time $T_2$, the emission current increases while fluctuating (usually, this period is called the terminal unstable region). In particular, when a time $T_3$ elapses, greater fluctuations are attended with, and if the field emission is still continued, the field emission cathode will be damaged by an overcurrent or electric discharge. It is accordingly necessary to cease the field emission at this time and clean and reproduce the field emission cathode by, for example, flashing it when the time $T_2$ has elapsed. When the field emission cathode is cleaned, it is reproduced so that the value of emission current may follow substantially the same time variation as in the above again. The cause for the fusion of the field emission cathode is that the overcurrent flows through the electron source. It is therefore apparent that the value of emission current must not exceed the allowable limit current value of the electron source, as indicated by $I_m$ in FIG. 1, throughout a period from the beginning to the end of the field emission. In other words, a high voltage to be applied to the field emission electron gun need be controlled so that the value of emission current may not exceed the allowable limit value $I_m$ throughout the period of the field emission.

For the above reason, in applying the high voltage to the field emission cathode, the operation has hitherto followed the steps described below. First of all, a sufficiently low voltage corresponding to an electron current of desired value is applied. Then, the electron current of desired value is emitted at the initial stage, but the emission current begins to decrease immediately. When the emission current has decreased to some extent, a voltage being somewhat higher than the first voltage is applied. While repeating such steps, the applied voltage is gradually raised, and the desired value of emission current ($I_1$) is finally attained stably. In FIG. 2, the states of variations of the value of the applied voltage (V) to the field emission cathode and the field emission current (I) with the lapse of the time (T) in the process of the operation are respectively shown by a curve *b* and a curve *c*.

Since, however, such operation is manually executed in the prior art, the job is highly complicated. Moreover, it is still feared that the cathode will be damaged by erroneously applying an excess voltage.

SUMMARY OF THE INVENTION

It is accordingly an object of this invention to provide a field emission electron gun which is improved so as to facilitate the adjusting job up to the stabilization of an emission current.

Another object of this invention is to provide a field emission electron gun which is improved so as to be capable of preventing the damage of a field emission cathode ascribable to the application of an excess voltage.

In order to accomplish the above-mentioned objects, this invention provides a power supply circuit for an electron gun which automatically controls a voltage to be applied to a cathode so as to make an emission current constant while the characteristic of emitting electrons from the cathode is in the initial unstable region described previously, and which functions so as to hold the voltage to be applied to the cathode constant while the electron emitting characteristic is in the stable region. That is, the field emission electron gun according to this invention performs a constant current operation while the electron emission characteristic lies in the initial unstable region, and the constant voltage operation while the characteristic lies in the stable region.

More concretely, the field emission electron gun according to this invention comprises a constant current control circuit which detects the value of emission current from the cathode, evaluates the difference between the detected current value and a desired value previously set, and controls the value of the voltage to be applied to the cathode so as to render the difference zero or below a predetermined value, and a constant voltage control circuit which stops the control operation of the constant current control circuit at a desired time and thereafter continues to hold the voltage to be applied to the cathode at a value immediately before the stopping of the constant current operation.

According to the characterizing construction of such field emission electron gun of this invention, the adjusting job before the characteristic of emitting electrons from the cathode becomes stable is facilitated, and the damage of the cathode attributed to the application of an excess voltage to the cathode is reliably prevented.

Further objects, features and functional effects of this invention will be self-explanatory from the following description of various exemplary embodiments.

DESCRIPTION OF THE PREFERRED EMBODIMENTS

Figure 3:
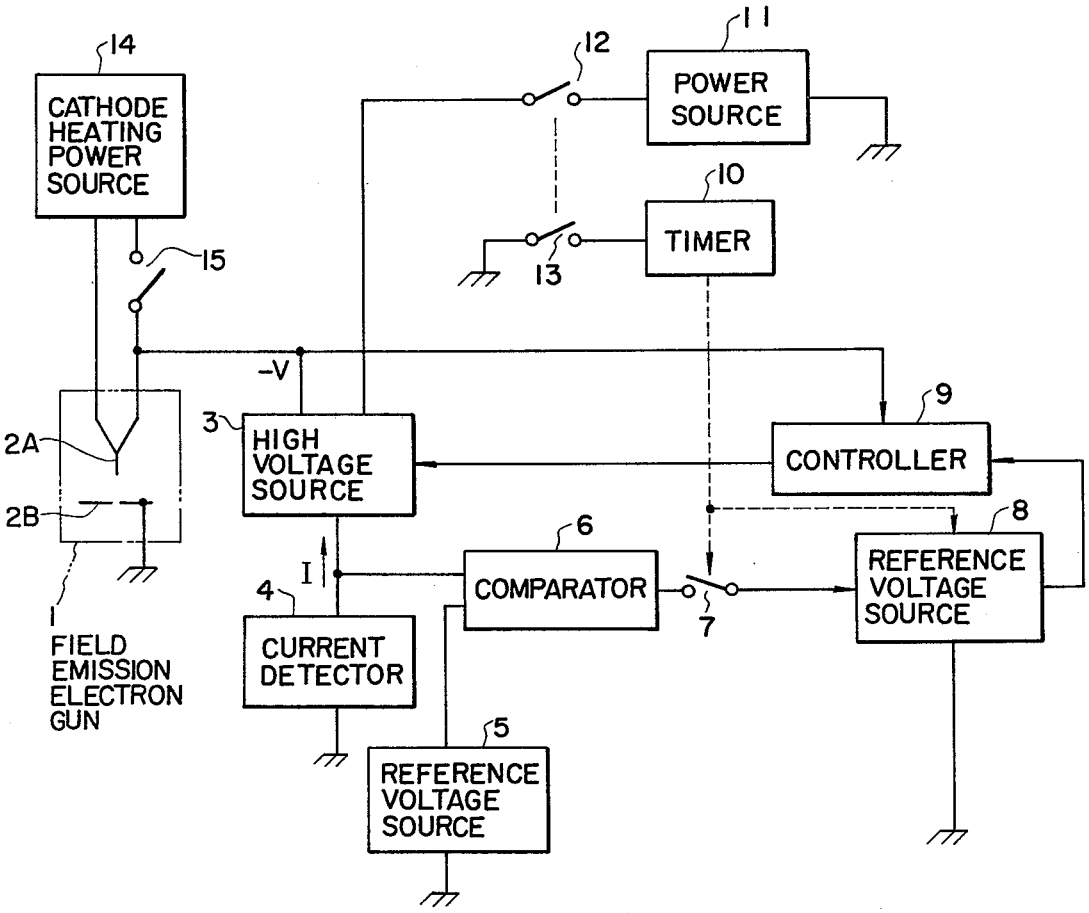
FIG. 3 is a block diagram showing the schematic circuit arrangement of a field emission electron gun embodying this invention.

FIG. 3 is a block diagram of an embodiment of this invention. A high voltage source 3 is connected between a field emission cathode 2A and an anode 2B of a field emission electron gun 1. On the ground side of the high voltage source 3, a detector 4 for a field emission current is connected in series. In the simplest case, the detector 4 may be a mere resistor. An output voltage of the detector 4 is entered into a comparator 6 together with an output voltage of a reference voltage source 5. The comparator 6 delivers an output voltage corresponding to the difference of both the input voltages. The output voltage of the comparator 6 is entered into a reference voltage source 8 through a switch 7 which is turned on and off by a timer 10. The reference voltage source 8 functions in such a manner that when the switch 7 is closed, a voltage to be fed to a high voltage controller 9 is controlled in response to the output voltage of the comparator 6, and that when the switch 7 is opened, a voltage having been fed to the high voltage controller 9 immediately before the opening of the switch 7 is continually fed to the high voltage controller 9 as it is. The high voltage controller 9 has the function of stabilizing and controlling an output voltage of the high voltage source 3 in response to the reference voltage which is supplied from the reference voltage source 8. Connected to the high voltage source 3 through a switch 12 is a power source 11 for operating the high voltage source 3. By closing a switch 13, the timer 10 is triggered to close the switch 7 and to begin the measurement of time. When a preset period of time has elapsed, the timer 10 opens the switch 7 again. The switches 12 and 13 are adapted to operate in interlocking relationship. Connected to the field emission cathode 2A through a switch 15 is a cathode heating power source 14 for heating and cleaning (flashing) the cathode.

In operation, the heating and cleaning of the field emission cathode 2A is executed by closing the switch 15. Thereafter, the switch 15 is opened again. Subsequently, the switches 12 and 13 are closed simultaneously. Upon the closure of the switch 13, the timer 10 is triggered to close the switch 7 and to begin the measurement of time. That is, the switch 7 is kept closed for the period of time set in the timer 10. Upon the closure of the switch 12, the high voltage source 3 is switched into the operative state, the high voltage is applied to the field emission cathode 2A, and an electron current based on the field emission begins to be emitted from the cathode 2A. The detection current value (I) is detected in the form of a voltage value by the detector 4. The output voltage is applied to one of input terminals of the comparator (for example, differential amplifier) 6. A voltage of a value corresponding to the desired emission current value (set value) is applied to the other input terminal of the comparator 6 by the reference voltage source 5. Accordingly, the output voltage of the comparator 6 becomes equal to the deviation of the emission current from the set value. The output voltage of the comparator 6 is applied to the reference voltage source 8 through the switch 7. In response to the input voltage, the reference voltage source 8 controls the reference voltage which is supplied to the high voltage controller 9. In response to the reference voltage supplied from the reference voltage source 8, the high voltage controller 9 controls the output voltage (V) of the high voltage source 3. A closed loop circuit which consists of the detector 4, comparator 6, reference voltage source 8, high voltage controller 9 and high voltage source 3 is constructed so as to perform negative feedback. In consequence, when the switch 7 is in the closed state, the output voltage of the high voltage source 3 is controlled so that the value of the electron current to be emitted from the field emission cathode 2A, accordingly the value of the output voltage of the detector 4, may always become equal to the set value, accordingly the value of the output voltage of the reference voltage source 5. That is, under this state, the output of the high voltage source 3 exhibits a constant current characteristic, and the electron gun 1 is brought into the constant current operation. When the timer 10 which has been set at the time corresponding to the initial unstable period anticipated is reset, the switch 7 is opened. Upon the opening of the switch 7, the reference voltage source 8 stops the operation of controlling the voltage to be supplied to the high voltage controller 9 in response to the output voltage of the comparator 6, and it continues to supply the voltage value having been supplied to the high voltage controller 9 immediately before the opening of the switch 7 as it is. That is, in this case, the output voltage of the high voltage source 3 becomes a constant value which is not affected by the changes of the emission current value. In other words, under this state, the output of the high voltage source exhibits a constant voltage characteristic, so that the electron gun 1 is brought into the constant voltage operation.

Figure 1:
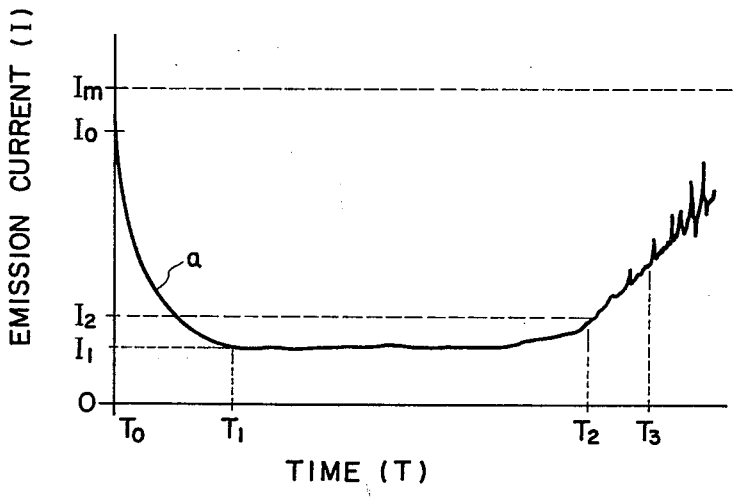
FIG. 1 is a characteristic curve showing an example of the time variation of an emission current (I) in the case where a voltage to be applied to the cathode of a field emission electron gun is kept constant.
Figure 2:
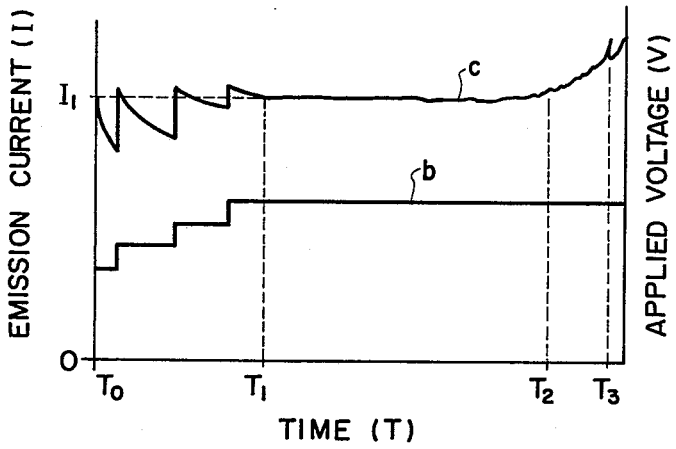
FIG. 2 is a characteristic curve showing examples of the time variations of an applied voltage (V) and an emission current (I) in the case where the voltage (V) to be applied to the cathode of a field emission electron gun is changed stepwise.
Figure 4:
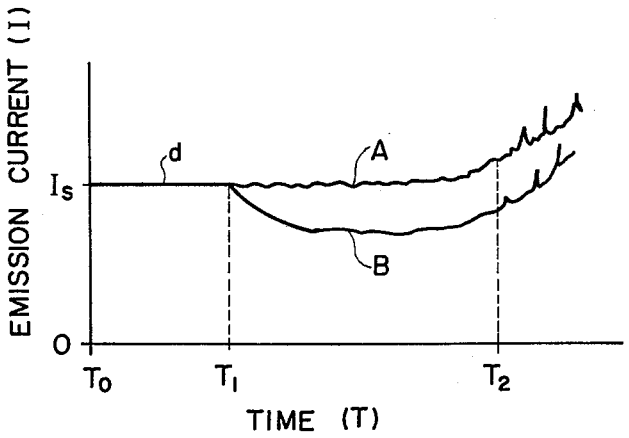
FIG. 4 is a characteristic curve showing the time variation of an emission current (I) in the field emission electron gun shown in FIG. 3.

FIG. 4 illustrates the state of the time variation of the field emission current in the case of employing the embodiment of this invention shown in FIG. 3. In FIG. 4, a period between times $T_o$ and $T_1$ is the period of the constant current operation of the electron gun, during which the value of the emission current is controlled so as to always become the set value $I_s$ as indicated by a straight line *d*. After the switch 7 is opened at the time $T_1$, the period of the constant voltage operation is established, and the output voltage of the high voltage source 3 becomes constant. Therefore, the emission current undergoes changes as shown by a curve A or B in conformity with the emission characteristic of the field emission cathode explained with reference to FIG. 1. More specifically, in some cases, as indicated by the curve A in FIG. 4, the stable region of the field emission characteristic begins from the time $T_1$ at which the constant voltage operation is changed-over to, and the emission current hardly changes till a time $T_2$ at which the stable region terminates. In the other cases, as indicated by the curve B, the initial unstable region still remains at the initial stage of the period after the change-over to the constant voltage operation, and the emission current value decreases for a while and then becomes stable. However, even in the case of the variation as illustrated by the curve B, any excess current does not flow through the field emission cathode, and hence, no hindrance is incurred in practical use. Of course, in such case where the decreasing tendency of the emission current in the initial unstable region still remains, the problem can be solved by making the set time of the timer 10 longer. The time length $T_1$ of the initial unstable region varies depending on the vacuum pressure of the interior of the electron gun, the residual gas components, the magnitude of the emission current, etc., and the value is several minutes in some cases and attains to several tens minutes in the other cases. As understood from FIG. 1, however, the change of the emission current is the most conspicuous immediately after the application of the high voltage to the field emission cathode, and no very large change is exhibited after such period. Accordingly, when the so-called constant current operation period in which the output voltage of the high voltage source 3 is controlled by the constant current circuit (i.e., the set time of the timer 10) is set at about 3 – 5 minutes, there hardly occurs the variation (decrease) of the emission current after change-over to the constant voltage operation.

Figure 5:
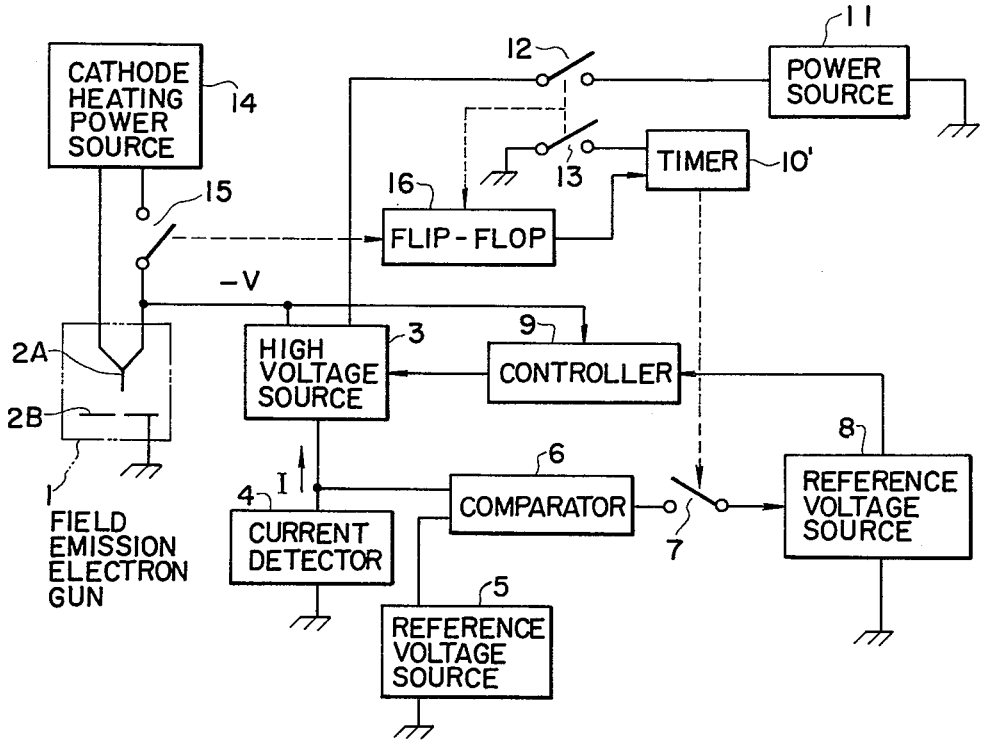
FIG. 5 is a block diagram showing the schematic arrangement of a field emission electron gun according to another embodiment of this invention.

It is not always the case that the electron gun is used continually to the termination of the stable region of the emission current. The field emission is sometimes stopped halfway in the stable region. In such case, the stable region is not terminated yet. In performing the next field emission again, therefore, it is unnecessary to carry out the cleaning and reproducing treatment owing to, for example, the heating of the field emission cathode, and it is allowed to apply the high voltage at once and to execute the constant voltage operation from the beginning. With the construction of the embodiment of this invention shown in FIG. 3, however, whenever the high voltage source 3 is operated by closing the power switch 12, the electron gun conducts the constant current operation at the beginning for about 3– 5 minutes set in the timer 10. This period of time becomes a sheer wait time (waste time), and is unfavorable in practical use. In order to eliminate such drawback, in the case where the heating reproduction treatment of the field emission cathode is unnecessary, the set time of the timer may be made short (several seconds or so). FIG. 5 is a block diagram showing another embodiment of this invention in which such measure is taken.

In FIG. 5, numeral 16 designates a flip-flop (discriminator), and symbol 10' a timer which has two, long and short set times. The other symbols represent the same parts as in FIG. 3. An output of the flip-flop 16 shall become "0" when the interlocking switch 12 (13) is opened to render the high voltage source 3 inoperative, and "1" when the switch 15 for the reproduction of the field emission cathode is closed. When the output of the flip-flop 16 is "0," the set time of the timer 10' becomes the short one of several seconds or so, whereas when the output of the flip-flop 16 is "1," the set time of the timer 10' becomes the long one of about 3 – 5 minutes. Accordingly, when the field emission is stopped by opening the switch 12, the output of the flip-flop 16 becomes "0," and the set time of the timer 10' is short. Subsequently, when the reproducing treatment of the cathode 2A is unnecessary, the timer 10' begins to operate under this short set time by closing the switch 13. In contrast, when the reproducing treatment of the cathode 2A is necessary, the output of the flip-flop 16 becomes "1" and the set time of the timer 10' is changed-over to the long one by closing the switch 15. Under this state, the timer 10' begins to operate under the long set time by closing the switch 13. In this way, when the heating reproduction treatment of the cathode 2A is not done, the constant voltage characteristic is changed-over to in several seconds, and hence, the drawback as described above can be obviated.

Figure 6:
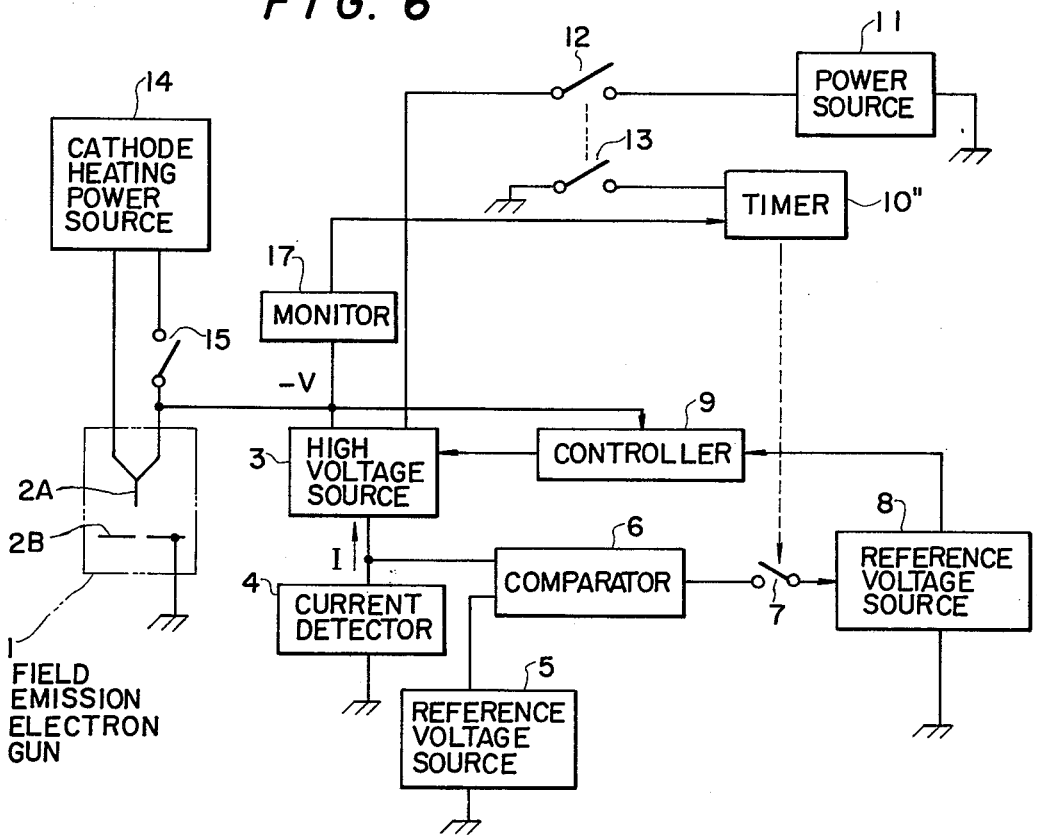
FIG. 6 is a block diagram showing the schematic arrangement of a field emission electron gun according to still another embodiment of this invention.

Further, if the time setting of the timer is automatically conducted, the period during which the electron gun is not useful (the so-called constant current operation period of the electron gun during which the output voltage of the high voltage source is controlled by the constant current circuit) can be made the shortest. FIG. 6 shows a block diagram of still another embodiment of this invention in which such measure is taken.

In FIG. 6, numeral 17 designates a high voltage monitor, and symbol 10'' a timer which is constructed so as to be reset by an output of the high voltage monitor 17. The other symbols represent the same parts as in FIG. 3. When the interlocking switches 12, 13 are closed, the high voltage source 3 is operated to generate the high voltage, and the electron current is emitted from the field emission cathode 2A. On the other hand, the timer 10'' is simultaneously triggered, the switch 7 is closed, and the constant current circuit operates to control the high voltage source 3 so that the emission current value of the electron gun may become equal to the set value. That is, when the field emission current intends to vary as explained with reference to FIG. 1, the output voltage (V) of the high voltage source 3 is varied so as to cancel out the variation of the emission current (I). The high voltage monitor 17 is made of a filter circuit. It produces an output "1" when the fluctuations of the output voltage (V) of the high voltage source 3 with the lapse of time have lowered into a predetermined range or have become null, while it holds an output "0" while the fluctuations are great beyond the predetermined range. The timer 10'' is reset and opens the switch 7 when the output of the high voltage monitor 17 becomes "1". Accordingly, if the set time of the timer 10'' is longer than the initial unstable period of the field emission current, the output voltage of the high voltage source 3 is controlled by the operation of the constant current circuit during the initial unstable period (i.e., it is fluctuating), so that the output of the high voltage monitor 17 is "0" and that the timer 10'' is not reset. When the time of the shift from the initial unstable region to the stable region of the emission current (transition stage) is reached soon, the output voltage of the high voltage source 3 comes to scarcely change, so that the the output of the high voltage monitor 17 becomes "1" and resets the timer 10". As the result, a switch 7 is opened, the output voltage of the reference voltage source 8 is held at the value immediately before the opening of the switch 7, and the output voltage of the high voltage source 3 is fixed to a constant voltage value which is determined by the output voltage value of the reference voltage source 8 as held. That is, the high voltage source 3 becomes a constant voltage source. The timer 10" of the embodiment herein explained may be replaced with a flip-flop. In this case, the construction may be so made that when the switch 13 is closed, an output of the flip-flop brings the switch 7 into the closed state, and that when the output of the high voltage monitor 17 becomes "1," the flip-flop is inverted.

As set forth above, according to this invention, the electron gun can be put into the constant current operation so that the emission current may become the current value previously set, during the initial unstable region in which the emission current changes. When the high voltage source 3 has changed-over to the operation as the constant voltage source, the emission current of the electron gun is already in the stable region, so that a emission current scarcely changes thereafter (for several minutes to several tens hours).

Figure 7:
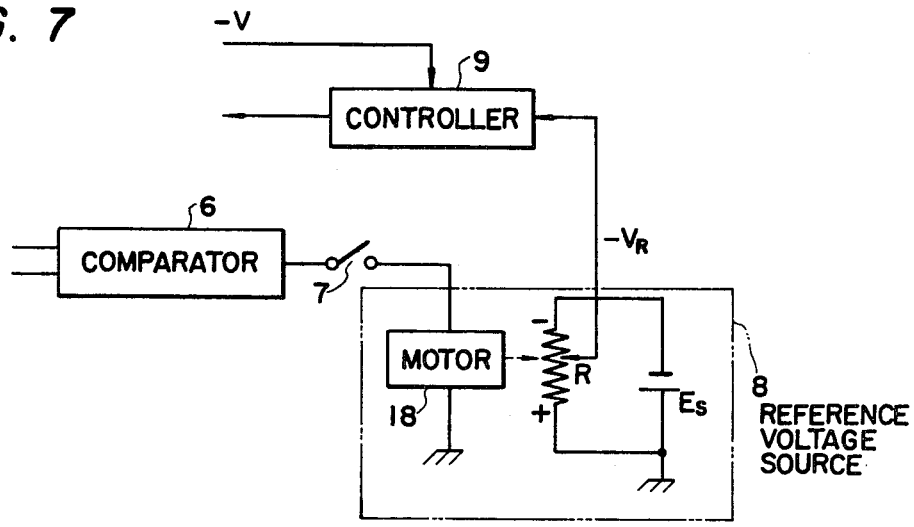
FIG. 7 is a diagram showing an example of the concrete circuit arrangement of a reference voltage source (indicated at 8) in each of the above embodiments of this invention.

As shown in FIG. 7, the reference voltage source 8 in each of the foregoing embodiments can be materialized by a variable resistance R which has a slide contact piece adapted to be driven by a motor 18 and across which a voltage $E_s$ is applied. When the switch 7 is closed, the motor 18 rotates in response to the output voltage of the comparator 6 and varies a voltage $V_R$ to be supplied to the high voltage controller 9. As the result, the high voltage controller 9 varies the output voltage of the high voltage source 3 in response to the voltage supplied from the reference voltage source 8 and operates so that the emission current of the electron gun may become equal to the set value (i.e., the output voltage of the comparator 6 may become zero). On the other hand, when the switch 7 is opened, the motor 18 stops. Therefore, a constant output voltage which is determined by the resistance value of the variable resistor R at that time is supplied to the high voltage controller 9, and a constant high voltage which is determined by the supplied voltage is applied to the cathode.

Figure 8:
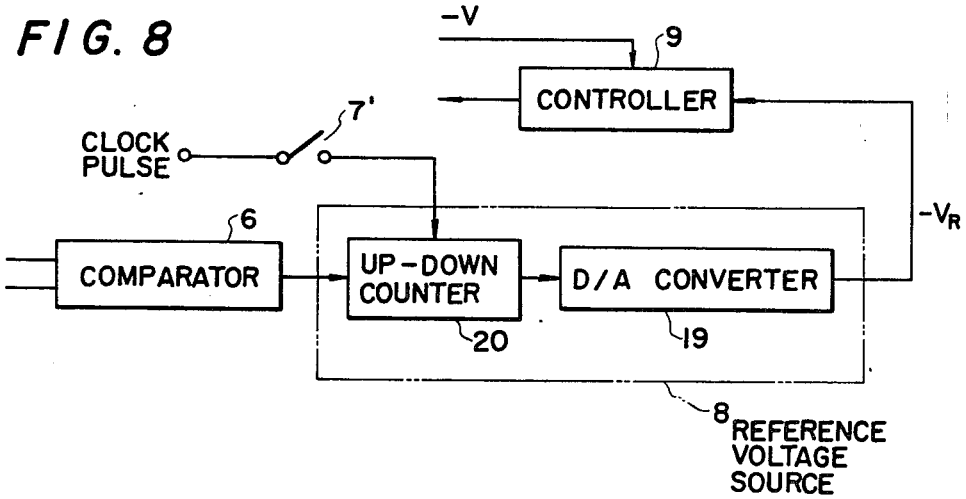
FIG. 8 is a diagram showing another example of the concrete circuit arrangement of the reference voltage source (8)

As shown in FIG. 8, the reference voltage source 8 can also be materialized by employing a D/A converter 19 and an up-down counter 20. At the constant current operation, clock pulses are impressed on the up-down counter 20 through a switch 7'. An output of the up-down counter 20 is converted into a voltage $V_R$ by the D/A converter 19, and the voltage is supplied to the high voltage controller 9. Whether the count of the counter 20 is "up" or "down" is determined by the polarity of the output voltage of the comparator 6. More specifically, when the output voltage of the comparator 6 is negative (the emission current is greater than the set value), the count is subjected to "down" so as to make the output voltage $V_R$ small, and when it is positive (the emission current is smaller than the set value), the count is subjected to "up" so as to make the output voltage $V_R$ great. In response to the change of the voltage $V_R$, the high voltage controller 9 varies the output voltage of the high voltage source 3 so as to make the emission current equal to the set value. When the switch 7' is opened, the clock pulses are prevented from being supplied to the up-down counter 20. Therefore, the count of the counter 20 becomes constant, and the D/A converter maintains the output voltage immediately before the opening of the switch 7' as it is and continues to supply it to the high voltage controller 9.

Figure 9:
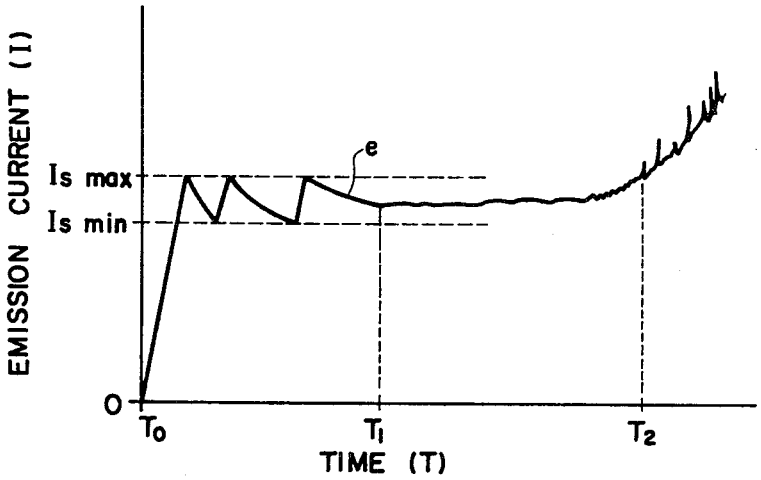
FIG. 9 is a characteristic diagram showing an example of the time variation of the emission current (I) in the case where the desired control value at the constant current control operation of the field emission electron gun according to this invention is endowed with a width.

In the embodiments shown in FIGS. 3, 5 and 6, the constant current circuit operates so that the emission current value of the field emission electron gun may exactly agree with the set value. It is not necessary, however, that the value of the field emission current is continually kept controlled to the fixed value during the initial unstable period. As illustrated by a curve *e* in FIG. 9, the emission current value may be controlled so as to lie between the maximum level $I_{s\,max}$ and the minimum level $I_{s\,min}$ of the control aim as have no considerably large difference. (In actuality, even when the design is made so that the emission current value may become just equal to the single set value, the emission current often shifts while repeating some upward and downward fluctuations in this manner.) By way of example, in the case of FIG. 9, the voltage to be applied to the field emission cathode is gradually raised from a time $T_o$. When the emission current value reaches the value $I_{s\,max}$, it is stopped to raise the applied voltage, and the applied voltage is held constant. Then, the emission current value gradually lowers and soon becomes the value $I_{s\,min}$. Here the applied voltage again starts rising, and when the emission current value reaches $I_{s\,max}$ again, the voltage rise is stopped. Such steps may be repeated till a time $T_1$. This is also a kind of constant current control. After the time $T_1$, that is, when the emission current has fallen into the stable region, the applied voltage to the cathode is fixed to a constant value. Then, the emission current value is stabilized between $I_{s\,max}$ and $I_{s\,min}$, and the electron gun can be stably utilized as such. Of course, in this case, the constant current circuit does not operate, either.

As explained above, with the field emission electron gun according to this invention, the problem of the fluctuations of the emission current as attributed to the instability of the characteristic of field emission from the cathode can be simply overcome by the automatic operation, and the desired emission current can be stably emitted.

We claim:

1. A field emission electron gun comprising a cathode for emitting electrons, an anode, a high voltage source which applies a high voltage between said cathode and said anode in order to emit the electrons from said cathode, a reference voltage source, a high voltage control circuit which controls the output voltage of said high voltage source in response to an output voltage of said reference voltage source, and a reference voltage control circuit which detects the emission current from said cathode and which controls said output voltage of said reference voltage source in response to the detected value.

2. The field emission electron gun according to claim 1, further comprising reference voltage hold means for stopping the control operation of said reference voltage control circuit and for holding said output voltage of said reference voltage source at a value immediately before the stop of said control operation.

3. The field emission electron gun according to claim 1, wherein the reference voltage control means comprises a detector which detects said emission current from said cathode, a comparator which compares the detected output voltage value of said detector with a voltage value previously set and which provides as an output a voltage corresponding to the difference of the comparison, and means for controlling said output voltage of said reference voltage source in response to the output voltage of said comparator.

4. The field emission electron gun according to claim 1, further comprising switching means for opening said reference voltage control circuit in order to stop the control operation of said reference voltage control circuit when a predetermined period of time has elapsed after initiation of the operation of said high voltage source.

5. The field emission electron gun according to claim 1, further comprising switching means for opening said reference voltage control circuit when a change of the output voltage of said high voltage source has become below a predetermined value.

6. The field emission electron gun according to claim 4, further comprising reference voltage hold means for holding said output voltage of said reference voltage source at a value immediately before the opening of said reference voltage control circuit when said reference voltage control circuit has been opened by said switching means.

7. The field emission electron gun according to claim 5, further comprising reference voltage hold means for holding said output voltage of said reference voltage source at a value immediately before the opening of said reference voltage control circuit when said reference voltage control circuit has been opened by said switching means.

* * * * *